US005343631A

United States Patent [19]

Shackelford et al.

[11] Patent Number: 5,343,631

[45] Date of Patent: Sep. 6, 1994

[54] TREATMENT OF FRIABLE MATERIALS IN FLUID BED REACTORS

[75] Inventors: Michael W. Shackelford, Carmel, Ind.; Robert G. Bauer, Gillette, Wyo.; George W. Land, Greenwood, Ind.

[73] Assignee: Amax Coal West, Inc., Gillette, Wyo.

[21] Appl. No.: 12,651

[22] Filed: Feb. 3, 1993

Related U.S. Application Data

[63] Continuation of Ser. No. 678,033, Apr. 1, 1991, abandoned.

[51] Int. Cl.[5] ..... F26B 3/08

[52] U.S. Cl. ..... 34/370; 110/245; 122/4 D; 432/58; 34/393; 34/579; 34/589

[58] Field of Search ..... 34/10, 12, 13, 57 R, 34/57 A, 57 C; 110/245, 347, 263; 122/4 D; 422/143; 165/104.16; 432/58; 431/7

[56] References Cited

U.S. PATENT DOCUMENTS

| | | | |
|---|---|---|---|
| 2,638,684 | 5/1953 | Jukkola | 34/10 |
| 2,638,685 | 5/1953 | Jukkola | 34/9 |
| 3,190,627 | 6/1965 | Goins | 34/10 |
| 3,190,867 | 6/1965 | Oldweiler et al. | 34/10 |
| 3,238,634 | 3/1966 | Goins | 34/10 |
| 4,226,835 | 10/1980 | Beranek et al. | 422/310 |
| 4,240,927 | 12/1980 | Karweil et al. | 252/411 |
| 4,324,544 | 4/1982 | Blake | 34/10 |
| 4,396,394 | 8/1983 | Li et al. | 34/13 |
| 4,401,436 | 8/1983 | Bonnecaze | 44/1 G |
| 4,495,710 | 1/1985 | Ottoson | 34/10 |
| 4,501,551 | 2/1985 | Riess et al. | 34/10 |
| 4,527,342 | 7/1985 | Li | 34/57 A |
| 4,616,426 | 10/1986 | Large | 34/57 |
| 4,624,058 | 11/1986 | Nakayasu et al. | 34/57 A |
| 4,761,131 | 8/1988 | Abdulally | 431/7 |
| 4,817,563 | 4/1989 | Beisswenger et al. | 122/4 |
| 4,864,944 | 9/1989 | Engstrom et al. | 110/299 |
| 4,955,295 | 9/1990 | Abdulally | 110/263 |

*Primary Examiner*—Denise Gromada
*Attorney, Agent, or Firm*—Sheridan Ross & McIntosh

[57] ABSTRACT

A process and apparatus for cooling coal dried in a fluid bed reactor are disclosed in which heated dried coal is separated into coarser and finer fractions and the coarser and finer fractions are separately cooled.

26 Claims, 3 Drawing Sheets

TREATMENT OF FRIABLE MATERIALS IN FLUID BED REACTORS

This is a continuation of co-pending application Ser. No. 07/678,033, filed on Apr. 1, 1991, now abandoned.

The invention is directed to a system for drying coal of sub-bituminous and lower rank wherein particle breakdown of the crushed coal during the drying operation is minimized.

BACKGROUND OF THE INVENTION

Sub-bituminous coals such as that of Wyoming's Powder River Basin as well as coals of lower rank such as brown coals and lignites are characterized by substantial water contents which can fall in the range of 25% to 40%, by weight. Such a high water content inhibits the use of these coals as fuel by reducing the heating value and increasing transportation cost. It has accordingly been considered desirable to dry such coals prior to shipment.

The problem has been discussed in U.S. Pat. No. 4,401,436 as follows:

> The drying required with such low rank coals is a deep drying process for the removal of surface water plus the large quantities of interstitial water present in such low rank coals. By contrast, when higher grade coals are dried, the drying is commonly for the purpose of drying the surface water from the coal particle surface but not interstitial water, since interstitial water content of the higher rank coals is relatively low. As a result, short residence times in the drying zone are normally used, and the interior portions of the coal particles are not heated, since such is not necessary for surface drying. Typically, the coal leaving the dryer in such surface water drying processes is a temperature below about 110° F. (45° C.). By contrast, processes for the removal of interstitial water require longer residence times and result in heating the interior portions of the coal particles. The coal leaving a drying process for the removal of interstitial water will typically be at a temperature from about 130° to about 250° F. (54° to 121° C.). When such processes for the removal of interstitial water are applied to low rank coals, the resulting dried coal has a strong tendency to spontaneously ignite, especially at the high discharge temperature, upon storage, during transportation and the like. As a result, a continuing effort has been directed to the development of improving methods whereby such lower grade coals can be dried and thereafter safely transported, stored and used as fuels.

It has been found, however, that the process of heating the coal to remove water and then cooling the heated coal produces a substantial quantity of fines, i.e., particles having a mean average particle size less than 8 mesh.

Sub-bituminous coal is usually crushed to a top size ¾" to 1-⅛" before drying. Some production of fines occurs on crushing. During the drying and cooling operations, attrition of the coal occurs in the fluid bed as particles are in contact in a moving gas stream and decrepitation of coal particles occurs during contact with the hot gas stream, which stream may be heated to a temperature on the order of 900° F. Exposure to the hot gas causes vaporization and expansion of gases within the coal particles, an effect which also results in particle breakdown. The accumulation of physical, thermal, and possibly, chemical effects result in undesirable particle breakdown and production of excessive amounts of fine material.

SUMMARY OF THE INVENTION

Broadly stated the present invention relates to treating friable material in a fluid bed to minimize or reduce decrepitation of the friable material by dividing the friable material into finer and coarser fractions and treating said fractions separately in a fluid bed reactor. Although numerous friable materials can be treated by the process in accordance with the present invention, the invention will be described in conjunction with the drying and cooling of sub-bituminous coal.

In accordance with the invention, coal of sub-bituminous or lower rank is dried to reduce the water content thereof by contact with a heated gas stream in a fluid-bed/flash combination type reactor to produce a finer stream of dried coal which exits the reactor with the gas stream and a coarser stream of dried coal which exits the reactor at substantially the reactor deck level and then cooling the two streams of dried coal separately in a fluid-bed type reactor by contact with cooling gas streams.

DETAILED DESCRIPTION OF THE INVENTION

Figure 1:
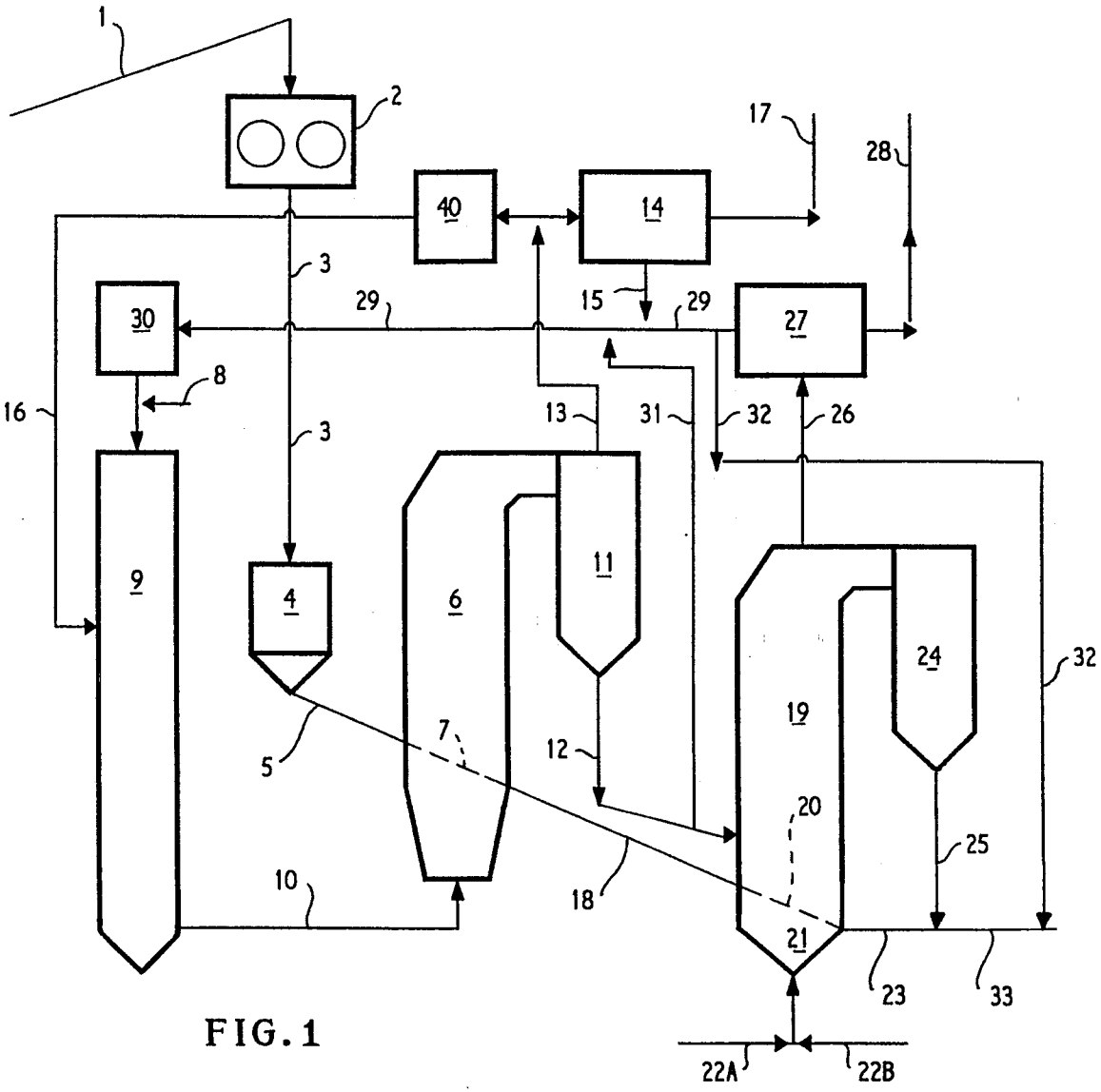
FIG. 1 depicts schematically a plant for drying coal.

The invention will now be described in conjunction with the drawing, in which FIG. 1 depicts a plant for drying coal, such as coal of sub-bituminous or lower rank.

In FIG. 1, a run of mine coal stream is charged through a line 1 from a coal processing plant to a crusher 2 where it is crushed to a suitable size and passed through a line 3 to a hopper 4. The particular coal in hopper 4 is fed through a line 5 into a dryer 6. In dryer 6, which is of the fluid bed type, the coal moves across dryer 6 above a deck 7 at a rate determined by the desired residence time in dryer 6. A hot gas is produced by injecting air through a line 8 to combust coal from bin 30 in a combustor 9. A stream of hot gases line (recycle) 16 after passing through inline filter 40 is also passed into combustor 9 and the hot gases from combustor 9 are forced to dryer 6 through line 10 and through the coal moving across deck 7 to dry the coal. The exhaust gas from dryer 6 is passed to a cyclone 11 where the coarsest fractions of finely divided solids, are separated from the exhaust gas and recovered through a line 12 to a cooler 19. Part of the exhaust gas, which still contains smaller solids, is passed through a line 13 to a fine solids recovery section 14 where the finest divided solids, which will typically consist primarily of finely divided coal, are recovered through a line 15 with all or a portion of the finely divided coal being recycled back to the fuel bin 30 through line 29 or recombined with the product through line 32. Part of the exhaust gas containing finely divided solids line 13 is recycled to the combustor 9 through line 16. The purified exhaust gas from fine solids recovery section 14 is passed through a line 17 to be discharged to the atmosphere.

The coarser dried coal product from dryer 6 is recovered via a line 18 to a cooler 19. The dried coal moves across cooler 19 above a deck 20. Cool gases are introduced under deck 20 through lines 22A and 22B and passed upwardly through the dried coal to cool the dried coal. The exhaust gas from cooler 19 is passed to a cyclone 24 where the coarser fractions of the finely divided solids are separated and recovered through a line 25 with the exhaust gas and finer fractions being passed through a line 26 to fine solids recovery section 27. The finer solids recovered in fine coal recovery section 27 are passed through line 29 to fuel bin 30 for fuel for combustor 9 or combined with product via line 32. Fuel for combustor 9 can also be taken from cyclone 11 through line 31 via a pulverizer (not shown) if necessary. The purified exhaust gas from fine solids recovery section 27 is passed through line 28 to be discharged to the atmosphere. The finer dried coal product is passed from cyclone 11 through line 12 to cooler 19 which is partitioned vertically to cool both fractions separately. The coarser cooled coal emerges from cooler 19 via product exit 23 and line 23 and is recovered to line 33.

Figure 2:
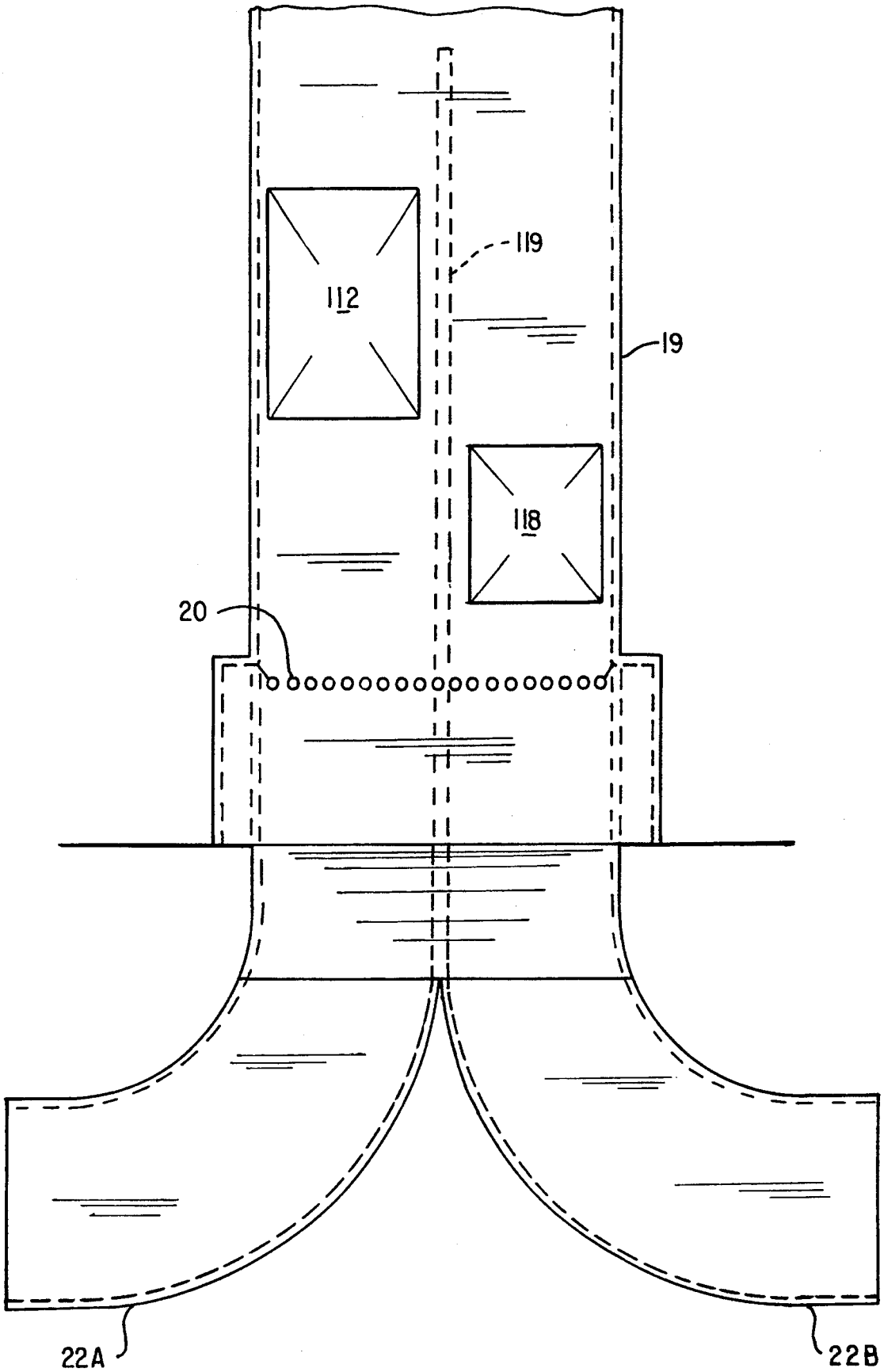
FIG. 2 depicts in elevation a fluid-bed type cooler for use in accordance with the invention.

FIG. 2 depicts in elevation cooling chamber 19 (FIG. 1) which is partitioned vertically by chamber partition 119 and is provided with deck 20 and two inlet air ducts 22A and 22B which are separated within chamber 19 (FIG. 1) by partition 119. Two coal inlets 112 and 118 are depicted, for the finer dryer cyclone underflow line 12 (FIG. 1) and the coarser dryer deck product line 18 (FIG. 1).

Figure 3:
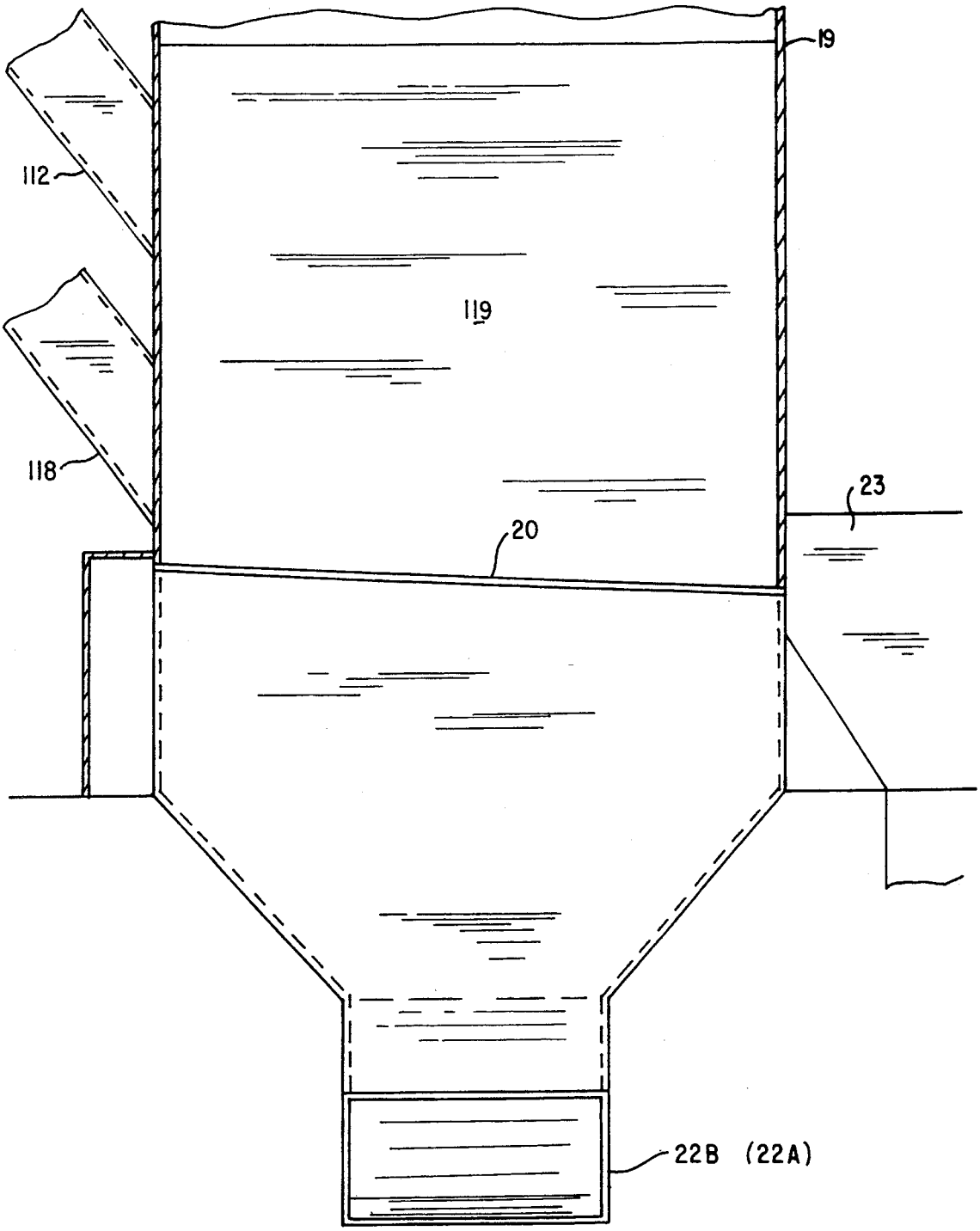
FIG. 3 depicts in elevation the fluid-bed type cooler as depicted in FIG. 2 in a view rotated 90° from that of FIG. 2.

FIG. 3 depicts at 90° from FIG. 2 removed in plan, an elevation of cooling chamber 19 (FIG. 1) wherein fine feed inlet 112, coarse feed inlet 118 and product exit 23 are shown. Partition 119 is shown as extending vertically through chamber 19 (FIG. 1) below the deck 20 (FIG. 1) such that air flows from the two inlet ducts 22A and 22B are kept separate. Underflow from cooler cyclone 19 (FIG. 1) is combined in the product.

In general terms, the particle size of the feed to cooler 19 from dryer deck 7 will be 1-$\frac{1}{8}$" to about 20 mesh, while the particle size of the dryer cyclone underflow line 12 will be on the order of 20 mesh to 0. In the prior system wherein the dryer cyclone underflow and the coarser dryer product were combined and fed to the cooler, it was found that the proportion of fines, i.e., particles below 8 mesh in size, in the final product was about 90% to about 95% thereof when a Wyoming sub-bituminous coal containing 30% moisture was dried. However, in treating the same coal in a system where the dryer cyclone underflow and the coarser dryer product are cooled separately, the proportion of fine particles less than 8 mesh in size is found to range on the order of about 70 to about 80%, by weight, of product.

While the invention has been illustrated by means of a cooler having a dividing partition to keep separate the air streams and their respective velocities for cooling the finer and coarser coal fractions, it is to be understood that separate coolers for finer and coarser fractions from the dryer can be employed with equivalent reduction in decrepitation of particles, but will require greater initial equipment cost, maintenance, costs and energy consumption. Separation of the finer and coarser cooler feed fractions permits cooling with optimum gas velocities and residence times for each size fraction, thereby reducing breakdown of coal particles and cost of operation.

As a further illustration, in an instance in which dryer cyclone underflow and dryer deck product were cooled to a temperature of about 90°-100° F. from an average temperature of 200°-205° F. for the dryer deck product and 160°-170° F. for the dryer cyclone underflow product in a vertically divided cooler, it was found that the deck open area (i.e., the area permitting gas flow through the deck or grate) could be reduced on the cooler deck side receiving the coarser particles from 12.5% to 7.0%, thereby affecting a reduction in gas flow from about 81,000 cubic feet per minute (12.5% deck open area) to about 53,500 cubic feet per minute (7.0% deck open area). This instance involved treating about 66 tons per hour each of dryer deck discharge and dryer cyclone product, respectively.

Although the present invention has been described in conjunction with preferred embodiments, it is to be understood that modifications and variations may be resorted to without departing from the spirit and scope of the invention as those skilled in the art will readily understand. Such modifications and variation are considered to be within the purview and scope of the invention and the appended claims.

What is claimed is:

1. Plant for drying coal comprising drying means for contacting said coal to be dried with a stream of heated gas, said drying means having a deck for retaining the coal and the coal being at least partially fluidized during drying with coarser particles of said coal exiting said drying means substantially at the same level of said deck and finer particles of said coal exiting said drying means with the exiting gas stream, and cooling means for cooling the dried coal, said cooling means having a split deck for retaining the coal, wherein said coarser dried particles and said finer dried particles are contacted by separate cooling gas streams supplied through said split deck, said finer particles being cooled separately from said coarser particles.

2. A method for reducing a temperature of first and second coal products in a cooling vessel, said cooling vessel comprising a housing separated into first and second sections which are substantially isolated from each other and a gas distribution deck positioned within each of said first and second sections to separate each of said first and second sections into upper and lower chambers, a substantial portion of said first coal product being comprised of coal particles within a first size range and a substantial portion of said second coal product being comprised of coal particles within a second size range which is different from said first size range, said method comprising the steps of:

providing said first coal product to said upper chamber of said first section of said cooling vessel;

providing said second coal product to said upper chamber of said second section of said cooling vessel;

introducing a cooling medium into said lower chamber of each of said first and second sections; and passing said cooling medium through said gas distribution deck of each of said first and second sections and said first and second coal products to separately reduce the temperature of said first and second coal products in said upper chamber of said first and second sections, respectively.

3. A method, as claimed in claim 2, wherein said introducing step comprises:

introducing a first cooling medium into said first section; and introducing a second cooling medium into said second section, wherein said introducing a first cooling medium step and said introducing a second cooling medium step are independently adjustable.

4. A method, as claimed in claim 3, wherein:

said first and second cooling mediums are each gaseous and fluidize said first and second coal products, respectively, within said first and second sections, respectively, of said cooling vessel.

5. A method, as claimed in claim 2, further comprising the steps of:

interconnecting said upper and lower chambers of said first and second sections by first and second flow paths, respectively, through said gas distribution deck of said first and second sections, respectively, said first coal product being generally coarser than said second coal product and said first flow path having a cross-sectional area which is different from a cross-sectional area of said second flow path.

6. A method, as claimed in claim 5, wherein:

said cross-sectional area of first flow path is smaller than said cross-sectional area of said second flow path.

7. A method, as claimed in claim 2, further comprising the steps of:

removing at least a portion of said first coal product from said first section of said cooling vessel after at least a portion of said introducing step;

removing at least a portion of said second coal product from said second section of said cooling vessel after at least a portion of said introducing step; and combining said portions of said first and second coal products removed from said first and second sections, respectively.

8. A method for reducing a temperature of first and second coal products discharged from a single drying vessel, a substantial portion of said first coal product being comprised of coal particles within a first size range and a substantial portion of said second coal product being comprised of coal particles within a second size range which is different from said first size range, said method comprising the steps of:

providing said first coal product to a first cooling vessel comprising a first housing and a first gas distribution deck which separates said first housing into upper and lower chambers;

introducing a first cooling medium into said lower chamber of said first housing;

passing said first cooling medium through said first gas distribution deck and said first coal product to reduce the temperature of said first coal product in said upper chamber of said first housing;

providing said second coal product to a second cooling vessel comprising a second housing and a second gas distribution deck which separates said second housing into upper and lower chambers;

introducing a second cooling medium into said lower chamber of said second housing; and passing said second cooling medium through said second gas distribution deck and said second coal product to reduce the temperature of said second coal product in said upper chamber of said second housing.

9. A method, as claimed in claim 8, wherein:

a flow rate of said first and second cooling mediums into said first and second cooling vessels, respectively, is independently adjustable.

10. A method, as claimed in claim 8, wherein:

said first and second cooling mediums are each gaseous and fluidize said first and second coal products, respectively, within said first and second cooling vessels, respectively.

11. A method, as claimed in claim 8, further comprising the steps of:

interconnecting said upper and lower chambers of said first and second cooling vessels by first and second flow paths, respectively, through said first and second gas distribution decks of said first and second sections, respectively, said first coal product being generally coarser than said second coal product and a cross-sectional area of said first flow path being different from a cross-sectional area of said second flow path.

12. A method, as claimed in claim 11, wherein:

said cross-sectional area of said first flow path is less than said cross-sectional area of said second flow path.

13. A method, as claimed in claim 8, further comprising the steps of:

removing at least a portion of said first coal product from said first cooling vessel after at least a portion of said passing a first cooling medium step;

removing at least a portion of said second coal product from said second cooling vessel after at least a portion of said passing a second cooling medium step; and combining said portions of said first and second coal products removed from said first and second cooling vessels.

14. An apparatus for modifying a temperature of first and second coal products, wherein a substantial portion of said first coal product is comprised of coal particles within a first size range and a substantial portion of said second coal product is comprised of coal particles within a second size range which is different from said first size range, said apparatus comprising:

a vessel separated into first and second sections for receiving said first and second coal products, respectively, said first and second sections being substantially isolated from each other, wherein a first member separates said first section into first and second chamber, said first and second chambers being fluidly interconnected by a first flow path having a first cross-sectional area, said first coal product being provided to said first chamber, and wherein a second member separates said second section into third and fourth chambers, said third and fourth chambers being fluidly interconnected by a second flow path having a second cross-sectional area which is different from said first cross-sectional area of said first flow path, said second coal product being provided to said third chamber;

first means for introducing a first temperature modifying medium into said first section, wherein said first means is dependent upon said first size range of said first coal product, said first temperature modifying medium being introduced into said second chamber and said first means comprising said first cross-sectional area of said first flow path; and second means for introducing a second temperature modifying medium into said second section, wherein said second means is dependent upon said second size range of said second coal product, said second temperature modifying medium being introduced into said fourth chamber and said second means comprising said second cross-sectional area of said second flow path.

15. An apparatus, as claimed in claim 14, wherein:

said first means comprises means for controlling a flow rate of said first temperature modifying medium directed toward said first coal product.

16. An apparatus, as claimed in claim 14, wherein:

said second means comprises means for controlling a flow rate of said second temperature modifying medium directed toward said second coal product.

17. A method for reducing a temperature of first and second coal products discharged from a coal dryer, wherein a substantial portion of said first coal product is comprised of coal particles within a first size range and a substantial portion of said second coal product is comprised of coal particles within a second size range substantially less than said first size range, comprising the steps of:

selecting a first velocity for a first cooling gas based upon said first size range of said first coal product;

passing said first cooling gas through said first coal product at said first velocity to reduce said temperature of said first coal product;

selecting a second velocity for a second cooling gas based upon said second size range of said second coal product to reduce said temperature of said second coal product, said first and second velocities being of different magnitudes; and passing said second cooling gas through said second coal product at said second velocity to reduce said temperature of said second coal product.

18. A method for reducing a temperature of first and second coal products in a cooling vessel having first and second sections which are substantially isolated from each other, comprising the steps of:

providing said first coal product to said first section of said cooling vessel;

providing said second coal product to said second section of said cooling vessel; and introducing a cooling medium to each of said first and second sections to separately reduce the temperature of said first and second coal products, wherein said introducing step comprises introducing a first cooling medium into said first section and introducing a second cooling medium into said second section, wherein said introducing a first cooling medium step and said introducing a second cooling medium step are independently adjustable.

19. A method, as claimed in claim 18, wherein:

said first and second cooling mediums are each gaseous and fluidize said first and second coal products, respectively, within said first and second sections, respectively, of said cooling vessel.

20. A method for reducing a temperature of first and second coal products in a cooling vessel having first and second sections which are substantially isolated from each other, comprising the steps of:

positioning first and second members within said first and second sections, respectively, of said cooling vessel to separate said first and second sections into upper and lower chambers;

providing said first coal product to said first section of said cooling vessel;

providing said second coal product to said second section of said cooling vessel;

introducing a cooling medium to each of said first and second sections to separately reduce the temperature of said first and second coal products; and interconnecting said upper and lower chambers of said first and second sections by first and second flow paths, respectively, said first coal product being generally coarser than said second coal product, said first and second coal products being provided to said upper chambers of said first and second sections, respectively, said cooling medium being introduced into said lower chambers of said first and second sections, respectively, and said first flow path having a cross-sectional area which is different from a cross-sectional area of said second flow path.

21. A method, as claimed in claim 20, wherein:

wherein said cross-sectional area of said first flow path is smaller than said cross-sectional area of said second flow path.

22. A method for reducing a temperature of first and second coal products in a cooling vessel having first and second sections which are substantially isolated from each other, comprising the steps of:

providing said first coal product to said first section of said cooling vessel;

providing said second coal product to said second section of said cooling vessel;

introducing a cooling medium to each of said first and second sections to separately reduce the temperature of said first and second coal products;

removing at least a portion of said first coal product from said first section of said cooling vessel after at least a portion of said introducing step;

removing at least a portion of said second coal product from said second section of said cooling vessel after at least a portion of said introducing step; and combining said portions of said first and second coal products removed from said first and second sections, respectively.

23. A method for reducing a temperature of first and second coal products discharged from a single drying vessel, comprising the steps of:

providing said first coal product to a first cooling vessel;

passing a first cooling medium through said first cooling vessel to reduce the temperature of said first coal product;

providing said second coal product to a second cooling vessel; and passing a second cooling medium through said second cooling vessel to reduce the temperature of said second coal product, wherein a flow rate of said first and second cooling mediums into said first and second cooling vessels, respectively, is independently adjustable.

24. A method for reducing a temperature of first and second coal products discharged from a single drying vessel, comprising the steps of:

providing said first coal product to a first cooling vessel;

passing a first cooling medium through said first cooling vessel to reduce the temperature of said first coal product;

providing said second coal product to a second cooling vessel;

passing a second cooling medium through said second cooling vessel to reduce the temperature of said second coal product;

positioning first and second members within said first and second cooling vessels, respectively, to separate each of said first and second cooling vessels into upper and lower chambers; and interconnecting said upper and lower chambers of said first and second cooling vessels by first and second flow paths, respectively, said first coal product being generally coarser than said second coal product, said first and second coal products being provided to said upper chambers of said first and second cooling vessels, respectively, said first and second cooling mediums being introduced into said lower chambers of said first and second cooling vessels, respectively, and a cross-sectional area of said first flow path being different from a cross-sectional area of said second flow path.

25. A method, as claimed in claim 24, wherein:

said cross-sectional area of said first flow path is less than said cross-sectional area of said second flow path.

26. A method for reducing a temperature of first and second coal products discharged from a single drying vessel, comprising the steps of:

providing said first coal product to a first cooling vessel;

passing a first cooling medium through said first cooling vessel to reduce the temperature of said first coal product;

providing said second coal product to a second cooling vessel;

passing a second cooling medium through said second cooling vessel to reduce the temperature of said second coal product;

removing at least a portion of said first coal product from said first cooling vessel after at least a portion of said passing a first cooling medium step;

removing at least a portion of said second coal product from said second cooling vessel after at least a portion of said passing a second cooling medium step; and combining said portions of said first and second coal products removed from said first and second cooling vessels.

* * * * *